US010276963B2

(12) United States Patent
Powell

(10) Patent No.: US 10,276,963 B2
(45) Date of Patent: Apr. 30, 2019

(54) TWO-PIECE ELECTRICAL CONNECTOR FOR JOINING FOIL CONDUCTORS

(71) Applicant: Michael Powell, Smyrna, GA (US)

(72) Inventor: Michael Powell, Smyrna, GA (US)

( * ) Notice: Subject to any disclaimer, the term of this patent is extended or adjusted under 35 U.S.C. 154(b) by 0 days.

(21) Appl. No.: 15/830,454

(22) Filed: Dec. 4, 2017

(65) Prior Publication Data

US 2018/0159260 A1 Jun. 7, 2018

Related U.S. Application Data

(60) Provisional application No. 62/429,134, filed on Dec. 2, 2016.

(51) Int. Cl.

| | |
|---|---|
| ***H01R 12/24*** | (2006.01) |
| ***H01R 13/426*** | (2006.01) |
| ***H01R 13/22*** | (2006.01) |
| ***H01R 13/64*** | (2006.01) |
| ***H01R 13/26*** | (2006.01) |
| ***H01R 13/622*** | (2006.01) |
| ***H01R 13/74*** | (2006.01) |
| *H01R 103/00* | (2006.01) |
| *H04R 1/06* | (2006.01) |

(52) U.S. Cl.

CPC ..... *H01R 13/426* (2013.01); *H01R 13/22* (2013.01); *H01R 13/26* (2013.01); *H01R 13/622* (2013.01); *H01R 13/64* (2013.01); *H01R 13/746* (2013.01); *H01R 2103/00* (2013.01); *H04R 1/06* (2013.01); *H04R 2420/09* (2013.01)

(58) Field of Classification Search

CPC ..... H01R 13/22; H01R 13/28
USPC ..... 439/495, 496, 289
See application file for complete search history.

(56) References Cited

U.S. PATENT DOCUMENTS

| | | | | |
|---|---|---|---|---|
| 2,969,510 A * | 1/1961 | White | H01P 1/047 | 174/88 C |
| 3,256,509 A * | 6/1966 | Dochat | H01R 12/81 | 174/88 R |
| 3,524,921 A * | 8/1970 | Wolf | H01B 7/0838 | 174/117 FF |
| 3,963,321 A | 6/1976 | Burger et al. | | |
| 4,143,931 A * | 3/1979 | Skare | H01R 12/67 | 174/117 A |

(Continued)

*Primary Examiner* — Neil Abrams
(74) *Attorney, Agent, or Firm* — Asgaard Patent Services, LLC; F. Wayne Thompson, Jr.

(57) ABSTRACT

Implementations of a two-piece electrical connector are provided. In some implementations, the two-piece electrical connector may be used to conductively connect two electronic devices (e.g., audio equipment). In some implementations, the two-piece electrical connector may be configured to reduce signal degradation (e.g., skin effect, noise, distortion, etc.) during transmission between connected electronic devices. In some implementations, the two-piece electrical connector may comprise a plug and a jack configured to connect together and thereby complete an electrical circuit. In some implementations, the plug and jack may each include two contacts. In some implementations, each contact is a segment of a foil conductor that is a single unitary piece of material (i.e., there are no breaks or soldered joints). In this way, through the use of foil conductors having a unitary construction, signal degradation is reduced between electronic devices connected together by a two-piece electrical connector.

13 Claims, 11 Drawing Sheets

(56) References Cited

U.S. PATENT DOCUMENTS

| | | | | | |
|---|---|---|---|---|---|
| 4,737,118 | A * | 4/1988 | Lockard | H01R 12/68 | 439/295 |
| 5,044,980 | A * | 9/1991 | Krumme | H01R 12/62 | 439/433 |
| 5,080,604 | A * | 1/1992 | Rider | H01R 13/631 | 439/357 |
| 5,123,852 | A * | 6/1992 | Gillett | H01R 12/853 | 439/496 |
| 5,133,667 | A * | 7/1992 | Daughtrey | H01R 12/62 | 439/378 |
| 5,316,486 | A * | 5/1994 | Tanaka | H01R 12/62 | 439/496 |
| 5,378,161 | A * | 1/1995 | Loder | H01R 12/714 | 439/496 |
| 5,664,953 | A * | 9/1997 | Reylek | H01R 13/2414 | 439/111 |
| 5,713,765 | A | 2/1998 | Nugent | | |
| 5,895,280 | A * | 4/1999 | Buss | H01R 12/778 | 439/271 |
| 6,049,041 | A * | 4/2000 | Yoshioka | H05K 1/09 | 174/117 FF |
| 6,176,716 | B1 | 1/2001 | Mercurio et al. | | |
| 6,416,350 | B1 * | 7/2002 | Harting | H01R 12/68 | 439/422 |
| 6,854,995 | B2 * | 2/2005 | Hotea | H01R 12/777 | 439/260 |
| 7,828,587 | B2 * | 11/2010 | Hernnant | H01R 13/22 | 439/495 |
| 2013/0017703 | A1 | 1/2013 | Gamelsky et al. | | |
| 2018/0159260 | A1 * | 6/2018 | Powell | H01R 13/426 | |

* cited by examiner

TWO-PIECE ELECTRICAL CONNECTOR FOR JOINING FOIL CONDUCTORS

CROSS REFERENCE TO RELATED APPLICATION

This application claims the benefit of U.S. Provisional Application Ser. No. 62/429,134, which was filed on Dec. 2, 2016, and is incorporated herein by reference in its entirety.

TECHNICAL FIELD

This disclosure relates to implementations of a two-piece electrical connector.

BACKGROUND

Electrical connectors general comprise a plug and a jack that complete an electrical circuit when joined together. The plug and jack of an electrical connector may be configured to join two lengths of flexible wire or cable, or to connect a wire or cable to an electrical terminal of an electronic device. As such, electrical connectors are routinely used to conductively connect two or more electronic devices.

The plug and jack of prior art electrical connectors are frequently soldered (or otherwise connected) to opposite ends of a round wire or cable. The junction between the wire and the plug or jack is a break in the conductive path that causes signal degradation (e.g., skin effect, noise, distortion, etc.) between devices conductively connected thereby. This signal degradation can adversely affect the performance of the conductively connected devices (e.g., the sound quality of a stereo system).

Accordingly, it can be seen that needs exist for the two-piece electrical connector disclosed herein. It is to the provision of a two-piece electrical connector configured to address these needs, and others, that the present invention in primarily directed.

SUMMARY OF THE INVENTION

Implementations of a two-piece electrical connector are provided. In some implementations, the two-piece electrical connector may be used to conductively connect audio equipment (e.g., power amplifier, equalizer, digital-to-analog converter, compact disc player, etc.) and/or other electronic devices. In some implementations, the two-piece electrical connector may be configured to reduce signal degradation (e.g., skin effect, noise, distortion, etc.) during transmission between connected electronic devices (e.g., audio equipment).

In some implementations, the two-piece electrical connector may comprise a plug and a jack configured to connect together and thereby complete an electrical circuit. In some implementations, the plug and jack may each include two contacts. In some implementations, each contact is a segment of a foil conductor that is a single unitary piece of material (i.e., there are no breaks or soldered joints). In this way, through the use of foil conductors having a unitary construction, signal degradation is reduced (e.g., skin effect, noise, distortion, etc.) between devices connected together by a two-piece electrical connector.

In some implementations, the first contact and the second contact of the plug are configured to conductively interface with the first contact and the second contact, respectively, of the jack. In some implementations, the jack may be configured so that the plug can only be connected thereto in a single orientation (i.e., the two-piece electrical connector is keyed). In this way, the contacts of the plug and jack are always properly oriented prior to conductive contact being made.

In some implementations, the jack may be fixed on the surface of a bulkhead and/or panel of an electronic device (e.g., a piece of audio equipment) and conductively connected thereto. In some implementations, a plug may be positioned on each end of a cable being used to connect two electronic devices, each equipped with a jack, together.

BRIEF DESCRIPTION OF THE DRAWINGS

FIGS. 3A-3C illustrate an example implementation of a jack according to the principles of the present disclosure, wherein FIG. 3C is a cross-sectional view.

FIGS. 4A-4C illustrate an example implementation of a plug according to the principles of the present disclosure, wherein FIG. 4C is a cross-sectional view.

DETAILED DESCRIPTION

Figure 1A:
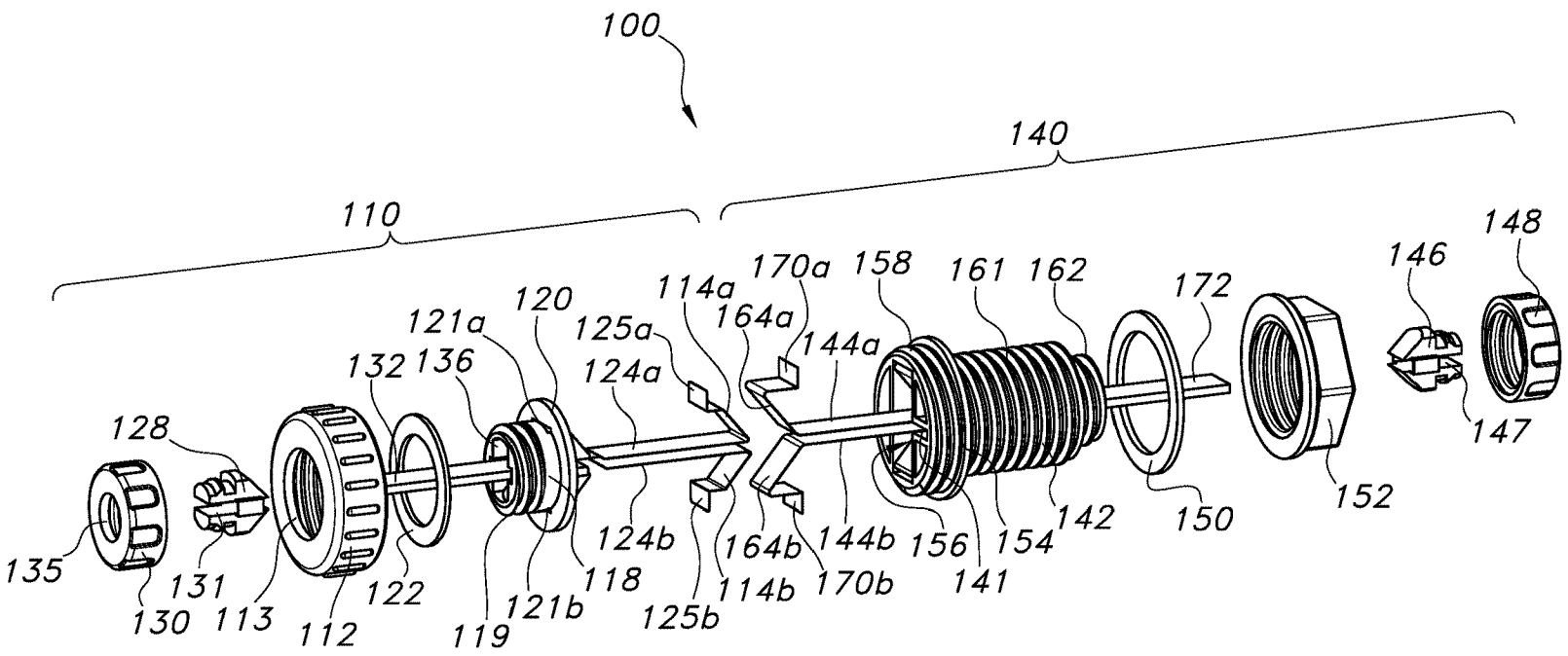
FIGS. 1A and 1B illustrate an example implementation of a two-piece electrical connector according to the principles of the present disclosure.
Figure 1B:
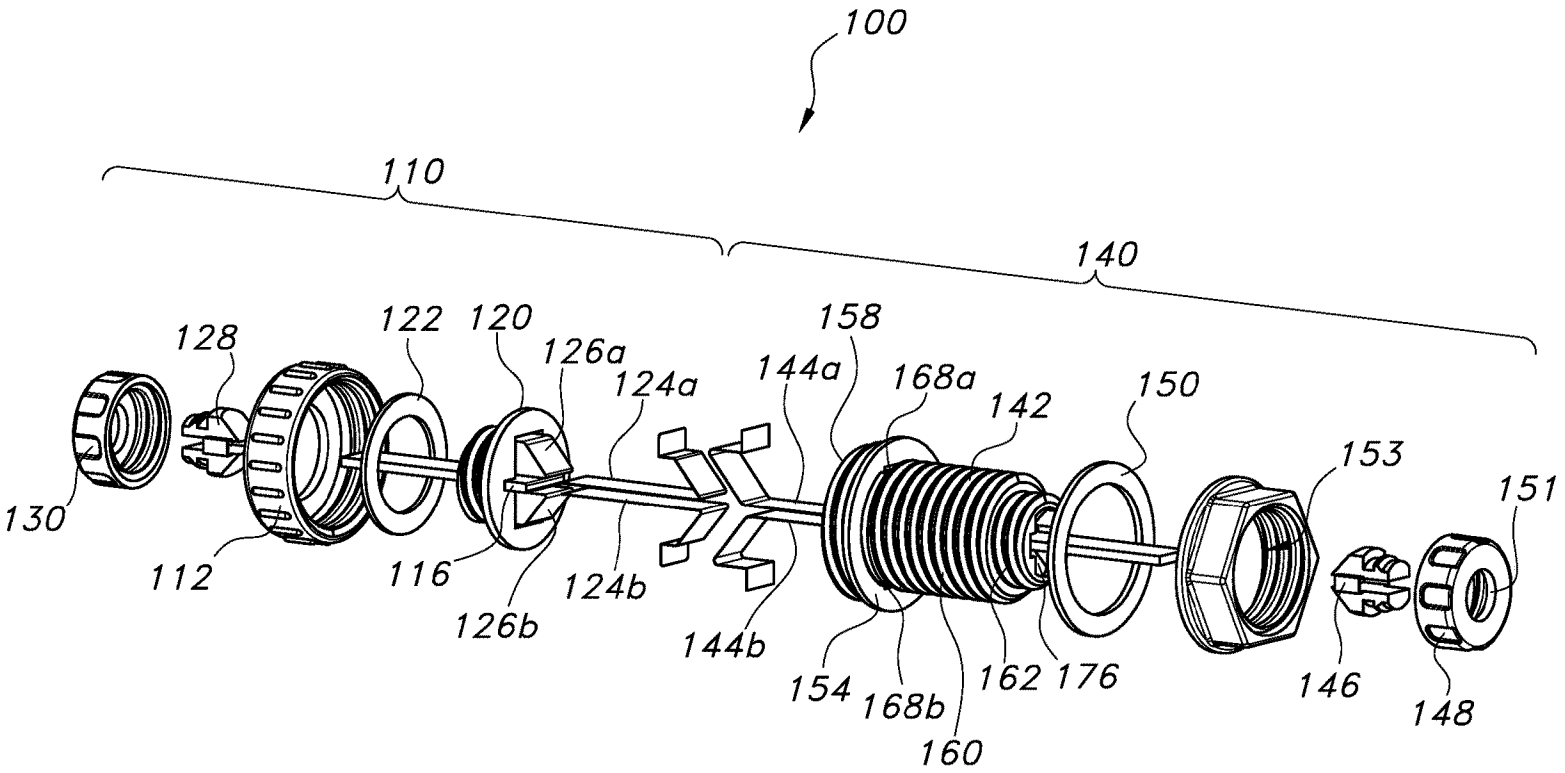

FIGS. 1A and 1B illustrates an example implementation of a two-piece electrical connector 100 according to the principles of the present disclosure. In some implementations, the two-piece electrical connector 100 may be used to conductively connect audio equipment (e.g., power amplifier, equalizer, digital-to-analog converter, compact disc player, etc.) and/or other electronic devices. In some implementations, the two-piece electrical connector 100 may be configured to reduce signal degradation (e.g., skin effect, noise, distortion, etc.) during transmission between connected electronic devices (e.g., audio equipment).

As shown in FIGS. 1A-1B and 2A-2C, in some implementations, the two-piece electrical connector 100 may comprise a plug 110 and a jack 140 configured to removably connect together and thereby complete a conductive path.

As shown in FIGS. 1A and 1B, in some implementations, the jack 140 may comprise a cylindrical body 142, a first foil conductor 144*a* and a second foil conductor 144*b* (collectively foil conductors 144), a foil clamp 146, and a clamp nut 148. In some implementations, the jack 140 may further comprise an insulating washer 150 and a retention nut 152 that may be used to fix the jack 140 on the surface of a bulkhead or panel 102 of an enclosure (see, e.g., FIGS. 2A and 2C).

Figure 2A:
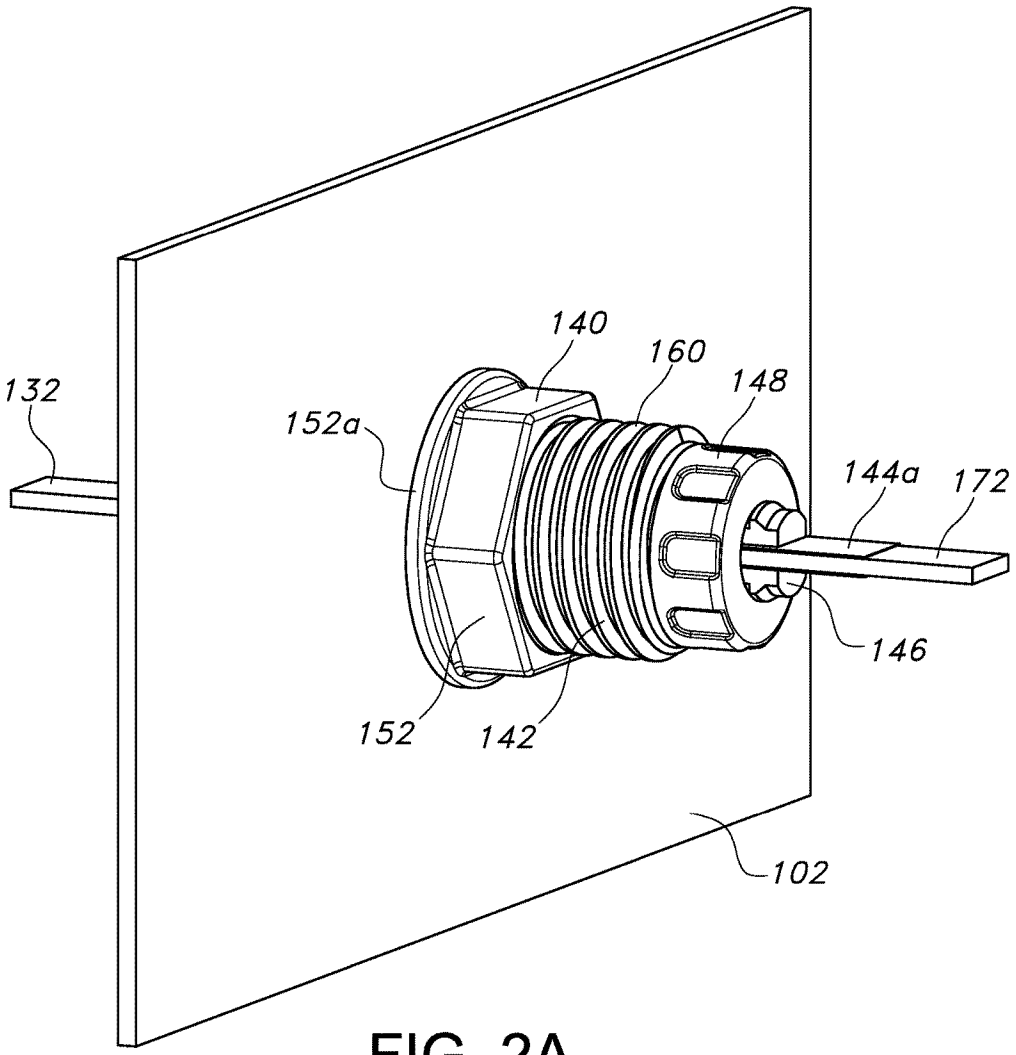
FIGS. 2A-2C illustrate the two-piece electrical connector shown in FIGS. 1A and 1B fixed to a panel.
Figure 2B:
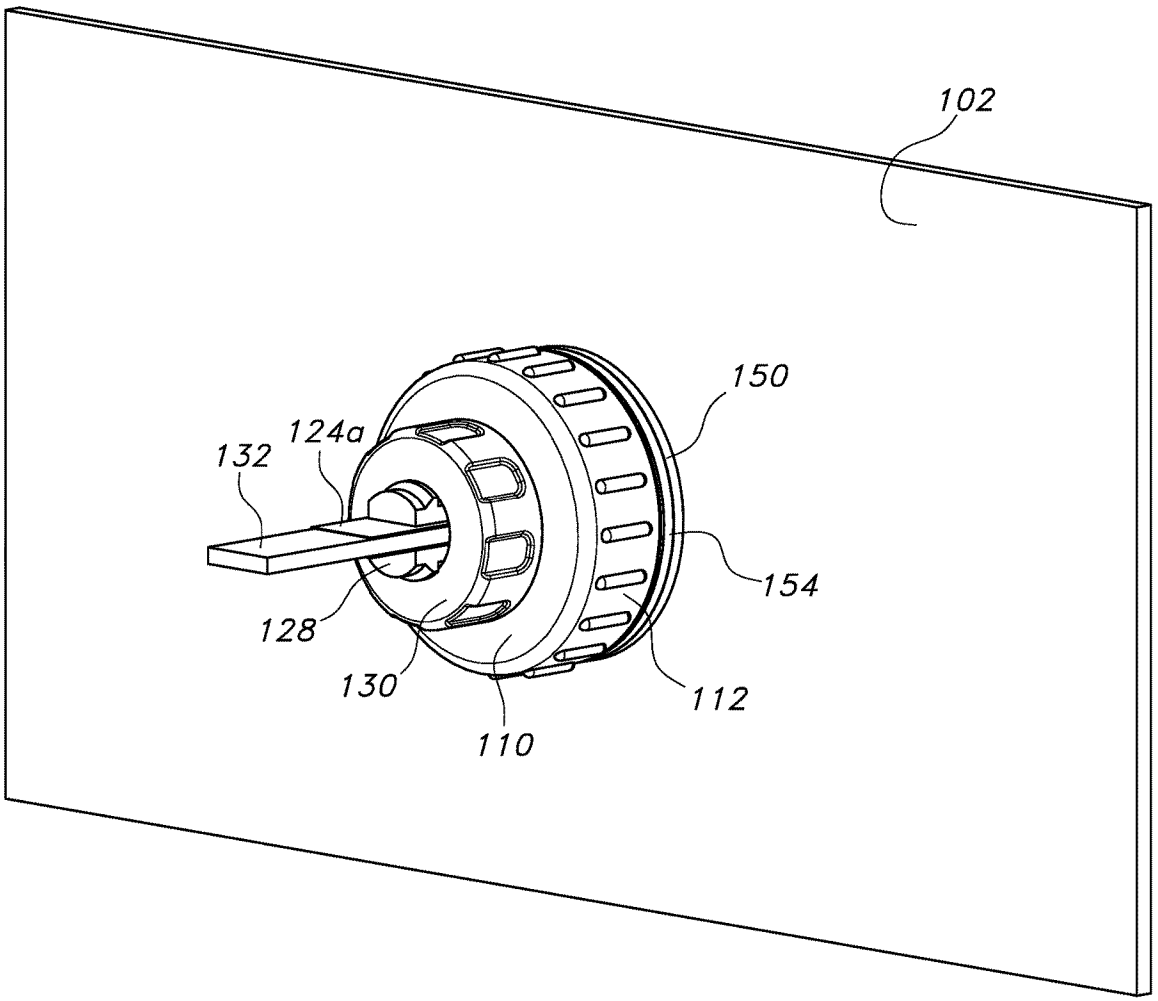
Figure 2C:
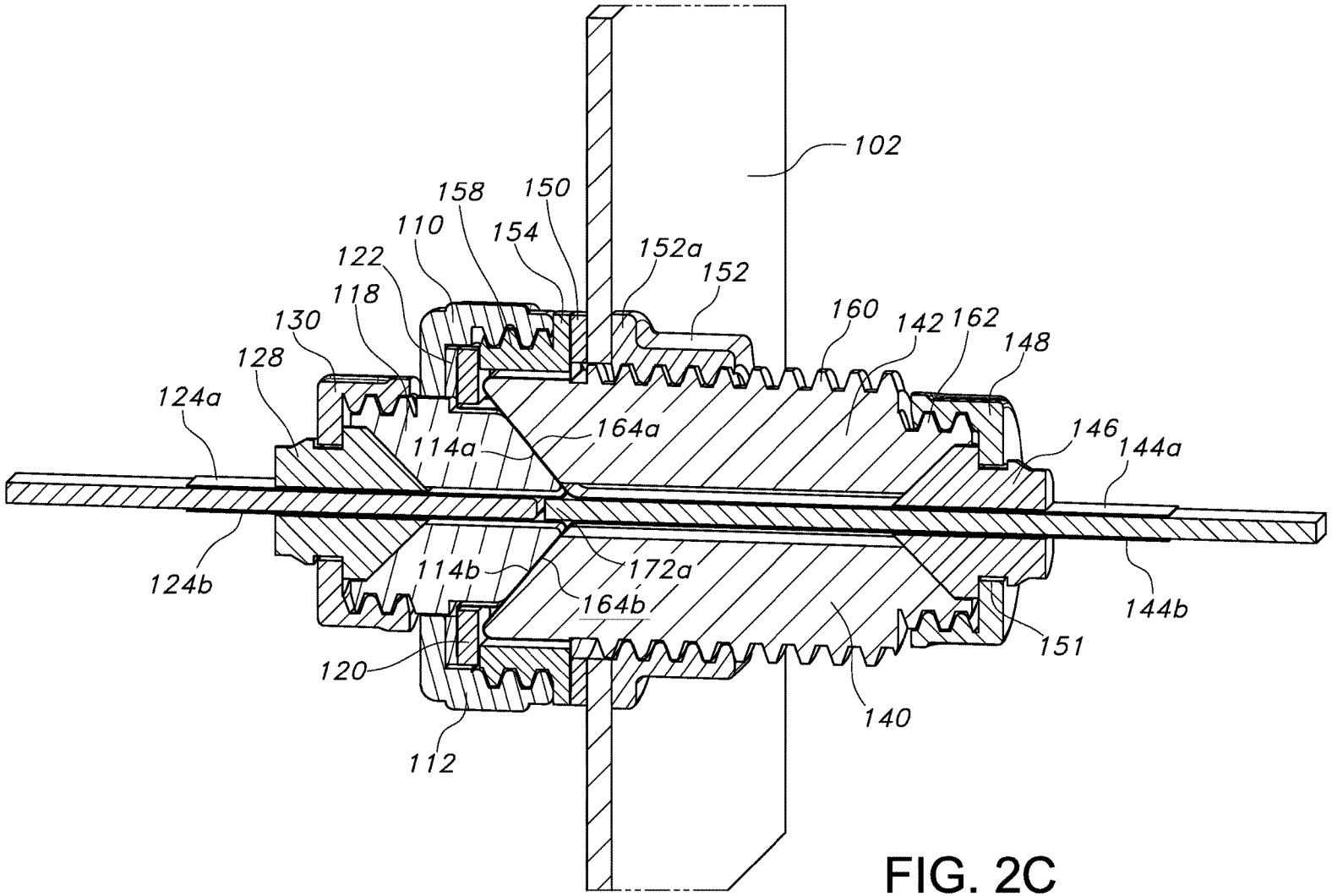
Figure 3A:
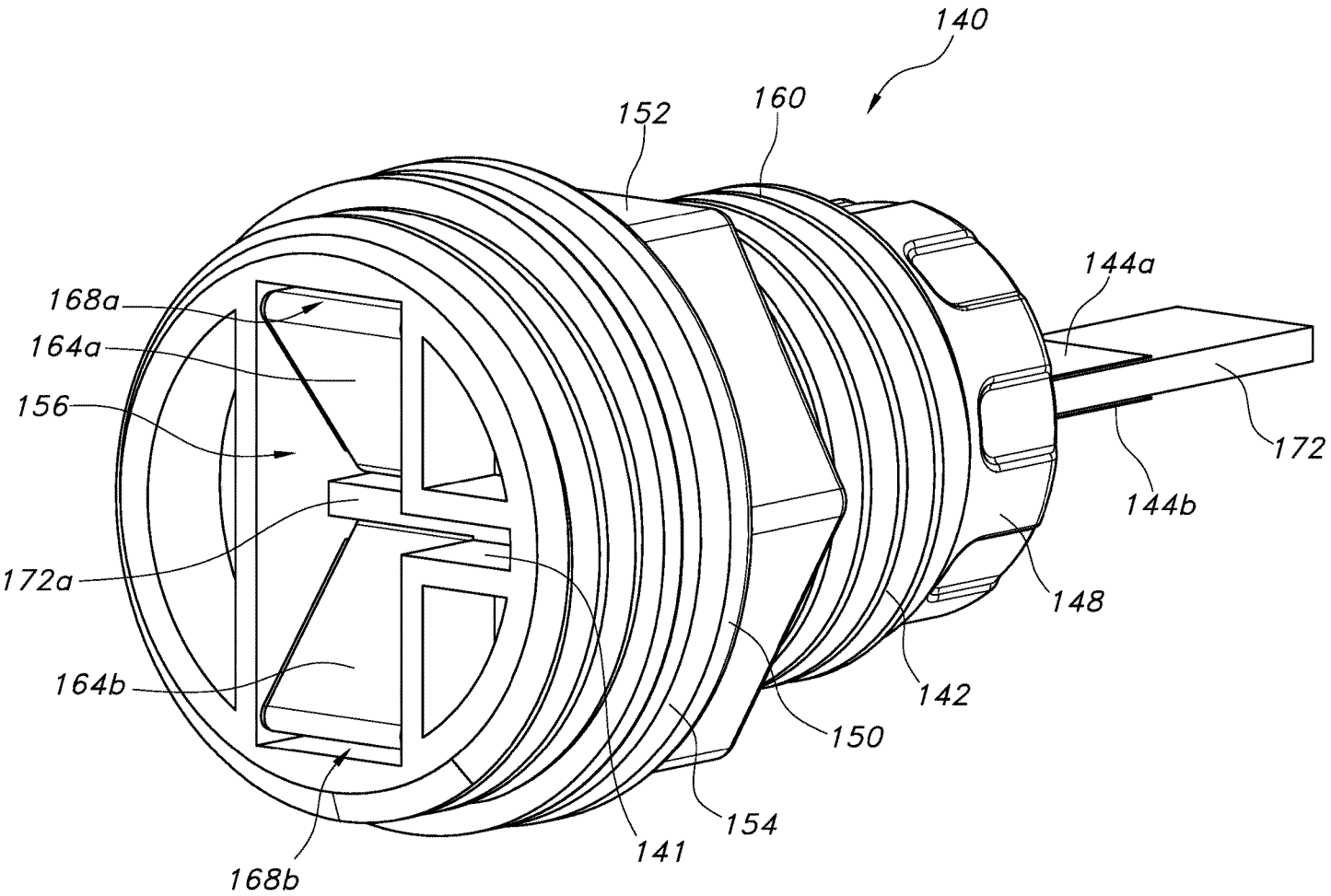
Figure 3B:
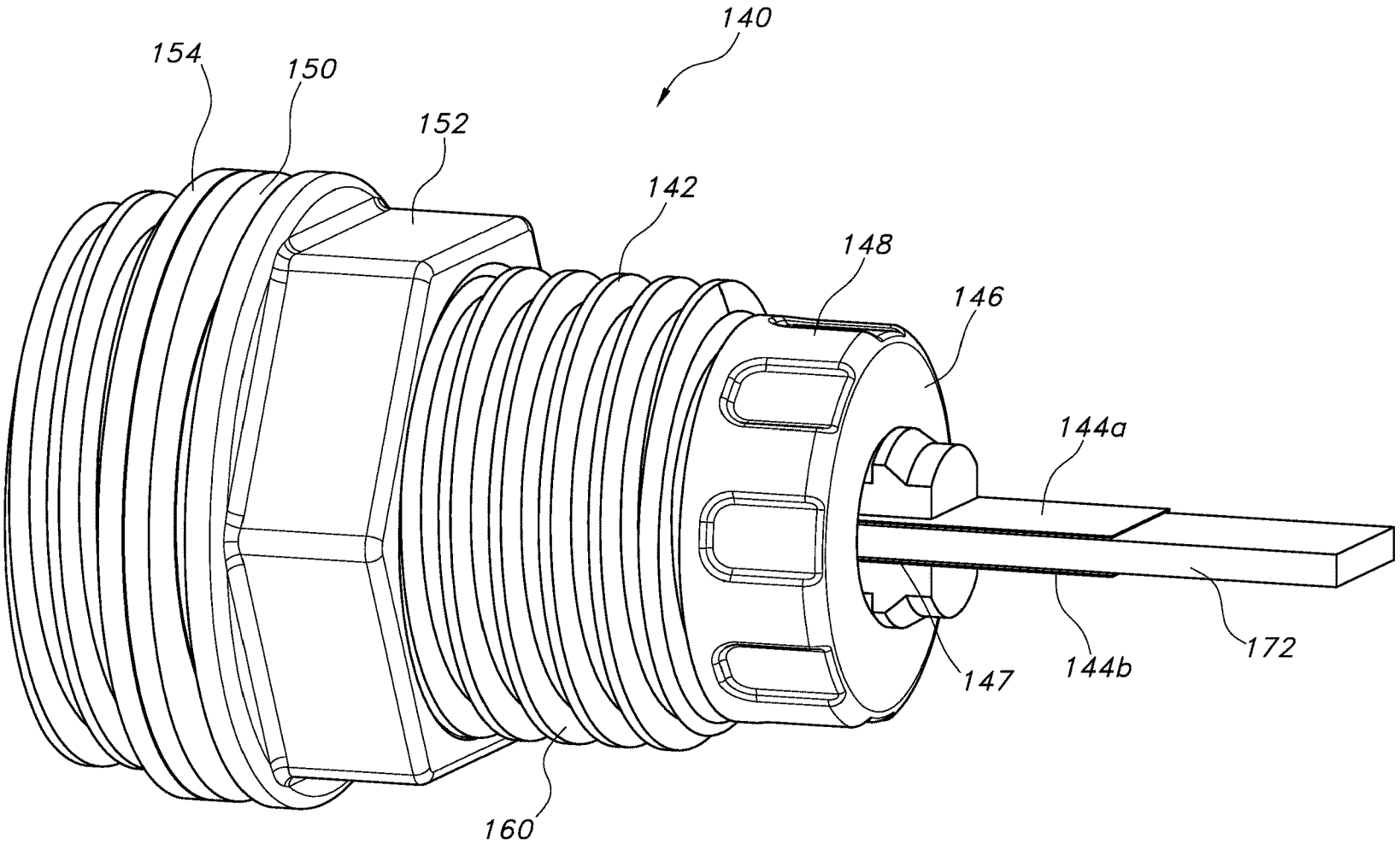
Figure 3C:
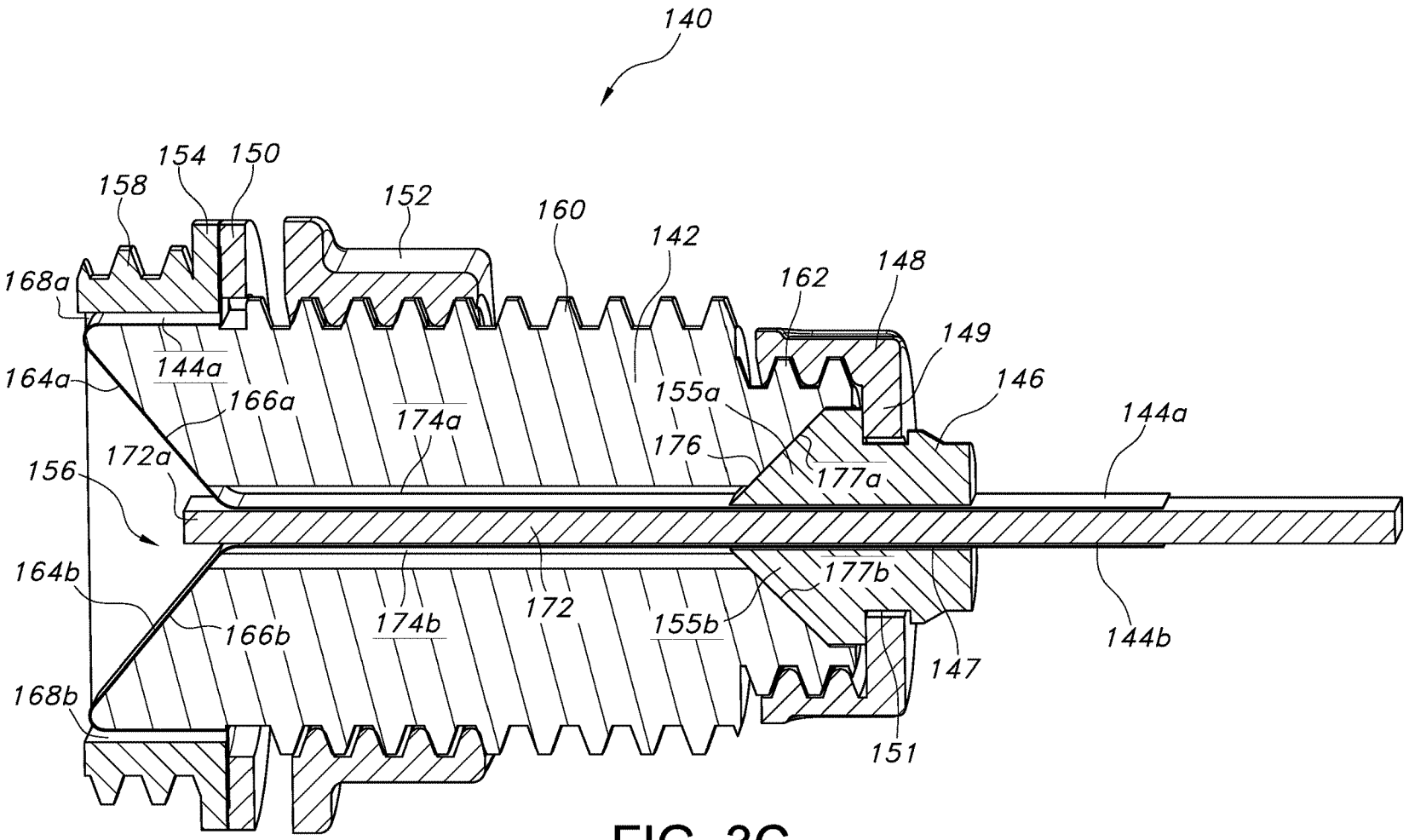

As shown in FIGS. 3A and 3C, in some implementations, the front end of the cylindrical body 142 may include a receptacle 156 that is configured to receive a portion of the plug 110 therein. In some implementations, the receptacle 156 is shaped for co-operative engagement with the male contacts 114*a*, 114*b* of the plug 110 (see, e.g., FIG. 2C). In some implementations, when viewed as a side cutaway, the receptacle 156 of the jack 140 may be generally "V-shaped" (see, e.g., FIG. 3C).

As shown in FIG. 3A, in some implementations, a first female contact 164*a* and a second female contact 164*b* may be positioned within the receptacle 156 of the jack 140. In some implementations, the first female contact 164*a* and the second female contact 164*b* may comprise a segment of the first foil conductor 144*a* and the second foil conductor 144*b*, respectively, of the jack 140.

As shown in FIG. 3C, in some implementations, the first female contact 164*a* and the second female contact 164*b* may be positioned within the receptacle 156 to overlay a first angled surface 166*a* and a second angled surface 166*b*, respectively, located therein. In some implementations, the degree of angle of the first angled surface 166*a* and female contact 164*a* compliment the angle of the first male contact 114*a* of the plug 110, while the second angled surface 166*b* and female contact 164*b* compliment the angle of the first male contact 114*a* of the plug 110. In this way, the male contacts 114*a*, 114*b* and the female contacts 144*a*, 144*b* may conductively interface when the plug 110 is connected to the jack 140 (see, e.g., FIG. 2C).

As shown in FIGS. 1B and 3C, in some implementations, a first slot 168*a* and a second slot 168*b* may extend from the top of each angled surface 166*a*, 166*b* through the annular flange 154 of the cylindrical body 142. In some implementations, the first slot 168*a* and the second slot 168*b* may be configured so that a portion of the first foil conductor 144*a* and the second foil conductor 144*b*, respectively, may be inserted therein and/or therethrough.

In some implementations, a portion of the first foil conductor 144*a* and the second foil conductor 144*b* may extend from the female contact 164*a*, 164*b* segments thereof, through the first slot 168*a* and the second slot 168*b*, respectively. In some implementations, a first end segment 170*a* and a second end segment 170*b* of the first foil conductor 144*a* and the second foil conductor 144*b*, respectively, may extend from an opening of the first slot 168*a* and the second slot 168*b*, respectively, in the back side of the annular flange 154 (see, e.g., FIG. 1B). In some implementations, the first end segment 170*a* and the second end segment 170*b* may be bent so that they rest against the back side of the annular flange 154 (see, e.g., FIG. 1A).

As shown in FIG. 3C, in some implementations, the insulating washer 150 may be configured to fit around the cylindrical body 142 of the jack 140 and rest against the back side of the annular flange 154. In some implementations, the insulating washer 150 may include a pressure sensitive adhesive on one side thereof. In this way, the insulating washer 150 may be affixed to the back side of the annular flange 154.

As shown in FIGS. 1A and 1B, in some implementations, the end segments 170*a*, 170*b* of the foil conductors 144*a*, 144*b* may be configured to be positioned between the annular flange 154 of the cylindrical body 142 and the insulating washer 150. In this way, when the jack 140 is fixed on the surface of a bulkhead and/or panel 102 of an enclosure, the annular flange 154 and the insulating washer 150 may clamp the end segment 170*a*, 170*b* of each foil conductor 144*a*, 144*b* therebetween and thereby secure them in position (i.e. the end segments 170*a*, 170*b* are anchored between the insulating washer 150 and the annular flange 154).

As shown in FIGS. 3A-3C, in some implementations, the jack 140 may include a centrally located, longitudinally extending, insulating divider 172. In some implementations, a front portion (or first end) 172*a* of the insulating divider 172 extends between the two female contacts 164*a*, 164*b* into the receptacle 156 of the jack 140. In some implementations, the insulating divider 172 may extend from the back side of the jack 140. In some implementations, the insulating divider 172 may be an integral portion of the cylindrical body 142 of the jack 140. In some implementations, the insulating divider 172 may not be an integral portion of the cylindrical body 142 of the jack 140.

As shown in FIG. 3C, in some implementations, the insulating divider 172 may be configured to insulate and separate the first foil conductor 144*a* from the second foil conductor 144*b*. In some implementations, a first longitudinal slot 174*a* and a second longitudinal slot 174*b* extending through the cylindrical body 142 of the jack 140 may be separated by the insulating divider 172.

As shown in FIG. 3C, in some implementations, a portion of the first foil conductor 144*a* and the second foil conductor 144*b* may extend through the first longitudinal slot 174*a* and the second longitudinal slot 174*b*, respectively, of the cylindrical body 142.

As shown in FIGS. 3B and 3C, in some implementations, a foil clamp 146 may be used to position and/or secure the first foil conductor 144*a* and the second foil conductor 144*b* against opposite sides of the insulating divider 172. In some implementations, the foil clamp 146 may be configured to not rotate when positioned within an opening 176 in the back side of the cylindrical body 142. In some implementations, the foil clamp 146 may include a first flexible jaw member 155*a* and a second flexible jaw member 155*b* extending from a front side thereof. In some implementations, each jaw member 155*a*, 155*b* may be configured (e.g., tapered) to fit within the opening 176 in the back side of the cylindrical body 142 and interface with a first tapered surface 177*a* and a second tapered surface 177*b*, respectively, therein (see, e.g., FIG. 3C). In some implementations, the foil clamp 146 may include a slot 147 therethrough. In some implementations, the slot 147 passes between the jaw members 155*a*, 155*b* of the foil clamp 146. In some implementations, the slot 147 may be configured for the insulating divider 172 and adjacent segments of the foil conductors 144 to pass therethrough (see, e.g., FIG. 3C).

As shown in FIG. 3C, in some implementations, the foil clamp 146 may be removably secured to the cylindrical body 142 of the jack 140 by the clamp nut 148. In some implementations, the clamp nut 148 may be configured to threadedly secure to the third screw thread 162 of the cylindrical body 142 (discussed in greater detail below). In some implementations, the clamp nut 148 includes a shoulder 149 having an opening 151 therethrough. In some implementations, the shoulder 149 of the clamp nut 148 may be configured to engage with and hold the foil clamp 146 in the opening 176 of the cylindrical body 142 when the clamp nut 148 is threadedly secured thereto (see, e.g., FIG. 3C). In this way, the clamp nut 148 may be used to removably secure the foil clamp 146 to the cylindrical body 142 of the jack 140.

In some implementations, as the clamp nut 148 is being threadedly secured to the cylindrical body 142, the tapered surfaces 177*a*, 177*b* within the opening 176 of the cylindrical body 142 may compress the jaw members 155*a*, 155*b* of the foil clamp 146 towards each other and thereby press the foil conductors 144 against the insulating divider 172. In this way, the foil clamp 146 may provide strain relief for, and/or ensure the proper positioning of, the foil conductors 144 within the cylindrical body 142 of the jack 140.

As shown in FIG. 3A, in some implementations, the receptacle 156 of the jack 140 may be configured so that the plug 110 can only be inserted therein in a single orientation (i.e., the two-piece electrical connector 100 is keyed). In this way, the male contacts 114*a*, 114*b* of the plug 110 and the female contacts 164*a*, 164*b* of the jack 140 are always properly oriented prior to conductive contact being made.

As shown in FIG. 3A, in some implementations, the receptacle 156 may include an offset slot 141 that may be configured to receive an orientation member 116 extending from between the male contacts 114*a*, 114*b* of the plug 110 (see, e.g., FIGS. 1A and 3A). In this way, the male contacts 114*a*, 114*b* of the plug 110 cannot be fully inserted into the receptacle 156 unless the orientation member 116 thereon is oriented to be received within the offset slot 141 of the receptacle 156. In some implementations, when viewed from the front, the opening into the receptacle 156 may be generally "T-shaped" (see, e.g., FIG. 3A).

As shown in FIGS. 2C and 3C, in some implementations, formed on the exterior of the cylindrical body 142 is a first screw thread 158, a second screw thread 160, and a third screw thread 162. In some implementations, the first screw thread 158 may be positioned in front of the annular flange 154 of the cylindrical body 142. In some implementations, the second screw thread 160 may be positioned behind the annular flange 142 of the cylindrical body 142. In some implementations, the third screw thread 162 may be positioned about the back end of the cylindrical body 142 and is smaller in diameter than the second screw thread 160 (see, e.g., FIG. 3C).

As shown in FIGS. 2B and 2C, in some implementations, the first screw thread 158 may be configured to threadedly engage with the connector nut 112 of the plug 110. In this way, the plug 110 and the jack 140 may be removably secured together and/or conductive contact therebetween maintained.

As shown in FIG. 2C, in some implementations, the second screw thread 160 may be configured to threadedly engage with the retention nut 152. In this way, the retention nut 152 in conjunction with the annular flange 154 and insulating washer 150 may be used to removably fix the jack 140 on the surface of a bulkhead or panel 102 of an enclosure (see, e.g., FIGS. 2A and 2C).

As shown in FIGS. 2A and 2C, in some implementations, the third screw thread 162 may be configured to threadedly engage with the clamp nut 148, as described above.

In some implementations, the following steps may be used to removably fix the jack 140 on the surface of a bulkhead and/or panel 102 of an enclosure (see, e.g., FIGS. 2A and 2C).

Initially, in some implementations, the insulating washer 150 may be positioned about the cylindrical body 142 of the jack 140 so that it is abutting the annular flange 154 thereof (see, e.g., FIG. 2B).

Then, in some implementations, the back side of the cylindrical body 142 may be slid through an opening within the panel 102 of an enclosure and positioned so that the insulating washer 150 is resting against the panel 102 (see, e.g., FIGS. 2B and 2C).

Next, in some implementations, the retention nut 152 may be threadedly secured to the second screw thread 160 of the cylindrical body 142. The retention nut 152 may be tightened until the shoulder 152*a* thereof makes contacted with the panel 102 of an enclosure thereby securing the jack 140 thereto (see, e.g., FIGS. 2A and 3C). The retention nut 152 includes an opening 153 therethrough that is configured to allow it to fit over the clamp nut 148 during installation (see, e.g., FIG. 1B).

As shown in FIGS. 1A and 1B, in some implementations, the plug 110 may comprise a body portion 118 having a screw thread 122 thereon, a first foil conductor 124*a* and a second foil conductor 124*b* (collectively foil conductors 124), a foil clamp 128, and a clamp nut 130. In some implementations, the plug 110 may further comprise an insulating washer 122 and a connector nut 112 that may be used to removably secure the plug 110 to the jack 140 of the two-piece electrical connector 100 (see, e.g., FIG. 2C).

Figure 4A:
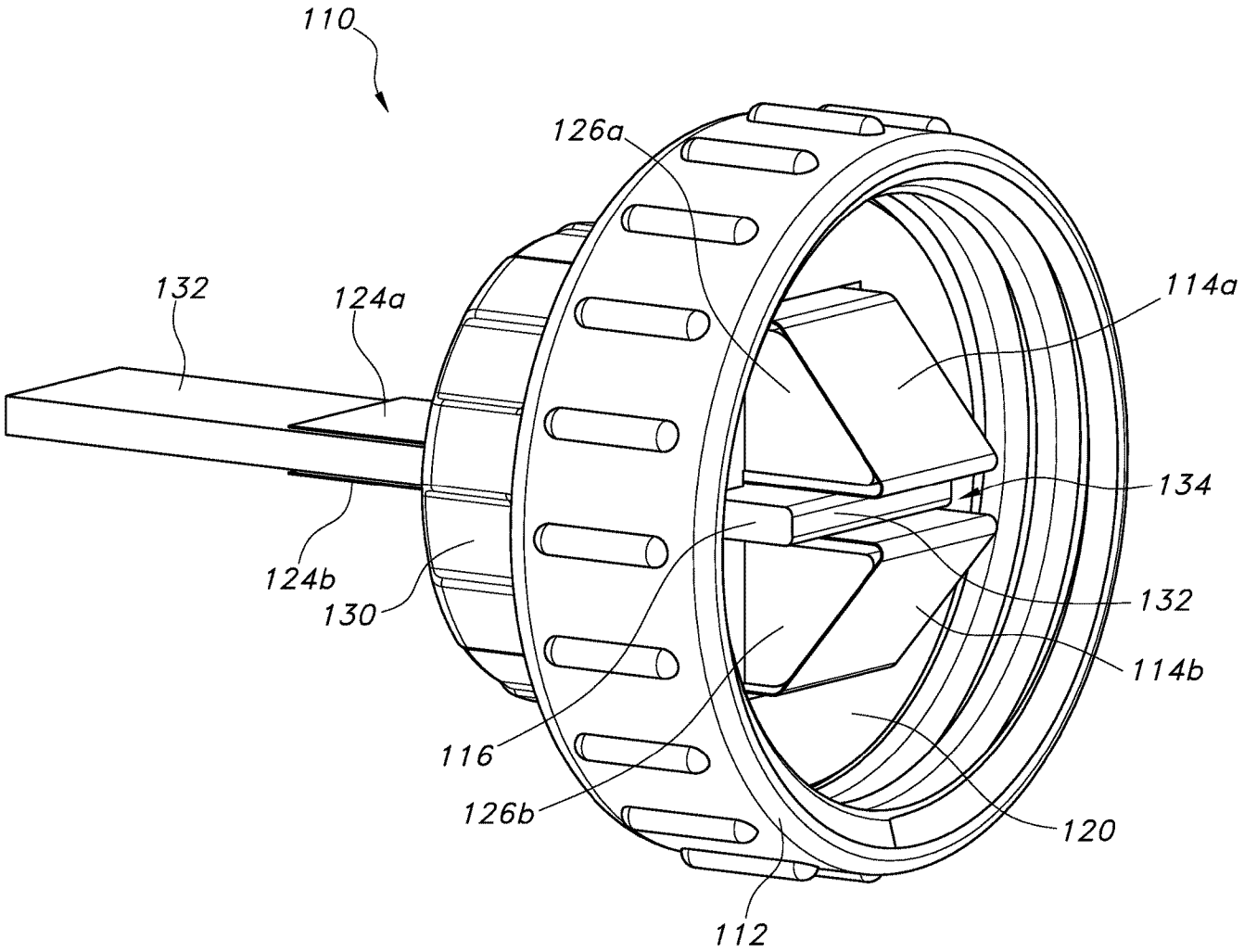
Figure 4B:
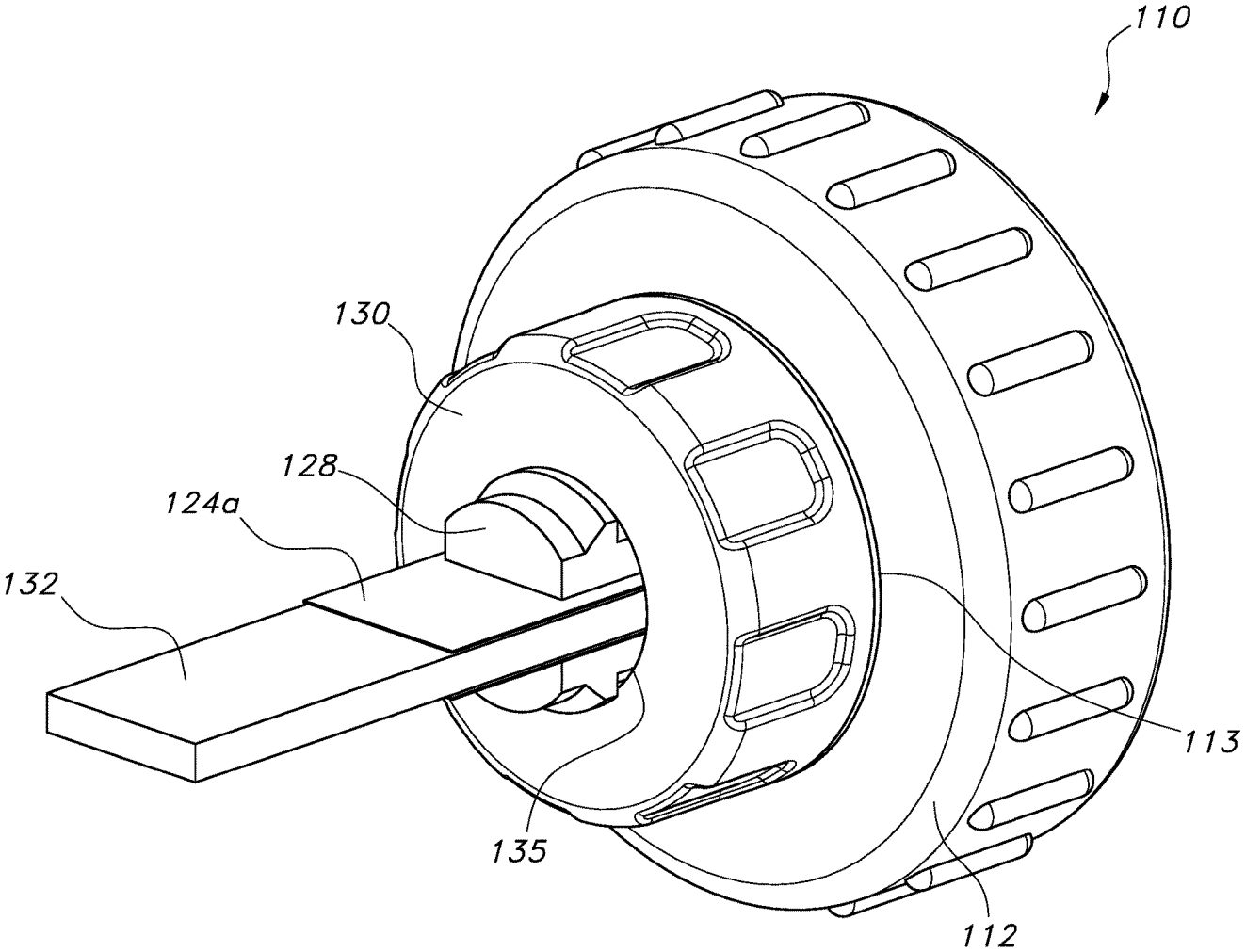
Figure 4C:
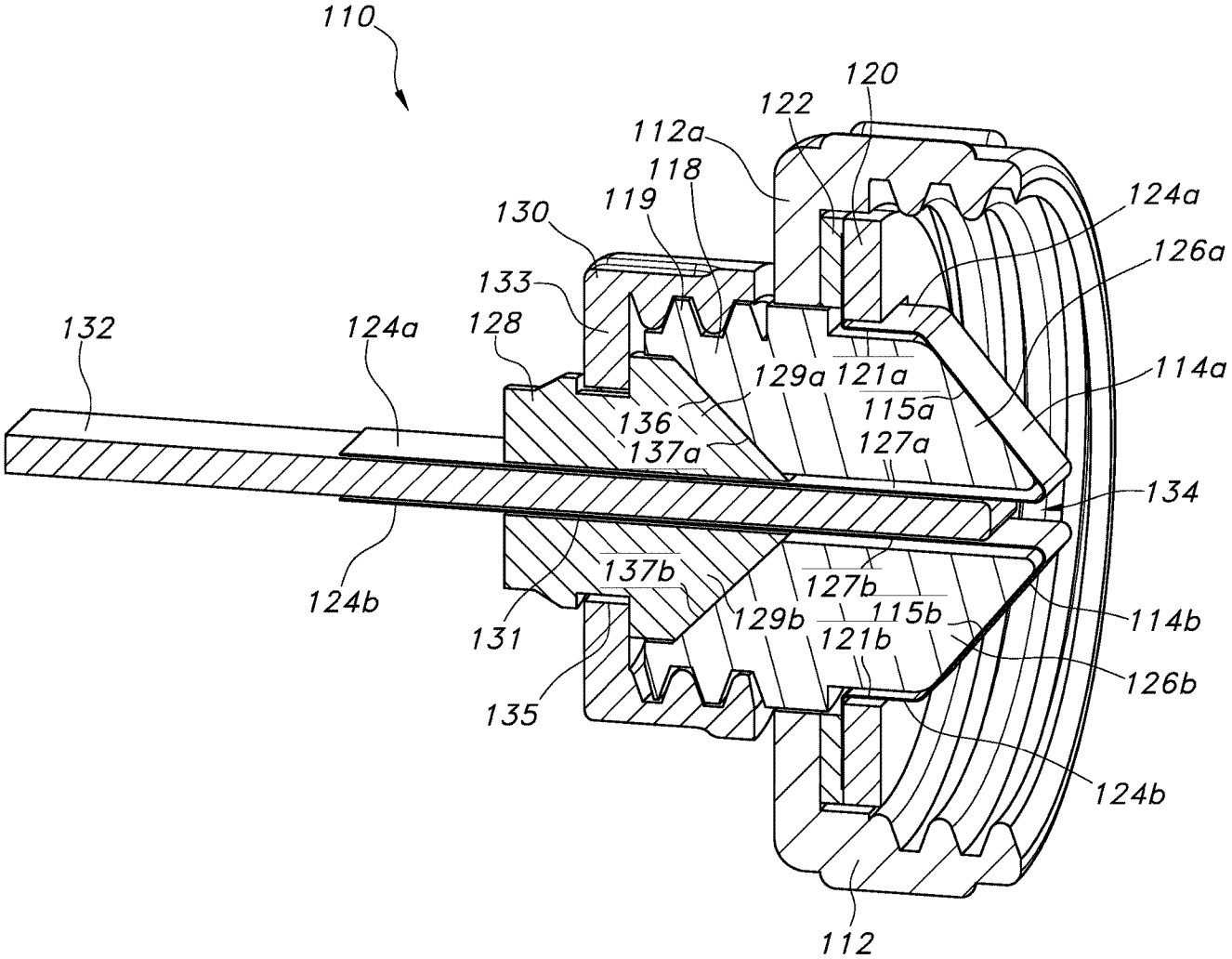

As shown in FIGS. 4A and 4C, a first male contact 114*a* and a second male contact 114*b* may be positioned to overlay a first protrusion 126*a* and a second protrusion 126*b*, respectively, extending from the annular flange 120 of the body portion 118 of the plug 110. In some implementations, the first male contact 114*a* and the second male contact 114*b* may comprise a segment of the first foil conductor 124*a* and the second foil conductor 124*b*, respectively, of the plug 110.

A shown in FIG. 4C, in some implementations, the first protrusion 126*a* and the second protrusion 126*b* may include a first angled surface 115*a* and a second angled surface 115*b*, respectively, on a front side thereof. In some implementations, the degree of angle of the first angled surface 115*a* and male contact 114*a* compliment the angle of the first female contact 164*a* of the jack 140, while the second angled surface 115*b* and male contact 114*b* compliment the angle of the second female contact 164*b* of the jack 140.

As shown in FIG. 4C, in some implementations, a first slot 121*a* and a second slot 121*b* may extend through the annular flange 120 of the body portion 118. In some implementations, the first slot 121*a* and the second slot 121*b* may be configured so that a portion of the first foil conductor 124*a* and the second foil conductor 144*b*, respectively, may be inserted therein and/or therethrough.

A shown in FIG. 1A, in some implementations, a first end segment 125*a* and a second end segment 125*b* of the first foil conductor 124*a* and the second foil conductor 124*b*, respectively, may extend through the first slot 121*a* and the second slot 121*b*, respectively, and out of the back side of the annular flange 120 of the plug 110. In some implementations, the first end segment 125*a* and the second end segment 125*b* may be bent so that they rest against the back side of the annular flange 120 (see, e.g., FIG. 1A).

As shown in FIG. 4C, in some implementations, the insulating washer 122 may be configured to fit around the body portion 118 of the plug 110 and rest against the back side of the annular flange 120. In some implementations, the insulating washer 122 may include a pressure sensitive adhesive on one side thereof. In this way, the insulating washer 122 may be affixed to the back side of the annular flange 120.

In some implementations, the end segments 125*a*, 125*b* of the foil conductors 124*a*, 124*b* may be configured to be positioned between the annular flange 120 of the body portion 118 and the insulating washer 122. In this way, when the connector nut 112 is used to threadedly secure the plug 110 to the jack 140, the annular flange 120 and the insulating washer 122 may clamp the end segment 125*a*, 125*b* of each foil conductor 124*a*, 124*b* therebetween and thereby secure them in position (i.e. the end segments 125*a*, 125*b* are anchored between the insulating washer 122 and the annular flange 120) (see, e.g., FIG. 2C).

As shown in FIGS. 4A-4C, in some implementations, the plug 110 may include a centrally located, longitudinally extending, insulating divider 132. In some implementations, the orientation member 116 of the plug 110 may extend from the front portion of the insulating divider 172 at a perpendicular angle (see, e.g., FIG. 4A). In some implementations, the orientation member 116 may extend from between the first and second protrusions 126*a*, 126*b* of the body portion 118. In some implementations, the orientation member 116 may extend from the front portion of the insulating divider 172 at a non-perpendicular angle. In some implementations, the insulating divider 132 may extend from the back side of the plug 110. In some implementations, the insulating divider 132 and the body portion 118 of the plug 110 may be a single unitary piece. In some implementations, the insulating divider 132 and the body portion 118 of the plug 110 may not be a single unitary piece.

As shown in FIG. 4C, in some implementations, the insulating divider 132 may be configured to separate the first foil conductor 124*a* from the second foil conductor 124*b*. In some implementations, a first longitudinal slot 127*a* and a second longitudinal slot 127*b* extending through the body portion 118 of the plug 110 may be separated by the insulating divider 132.

As shown in FIG. 4C, in some implementations, a portion of the first foil conductor 124*a* and the second foil conductor 124*b* may extend through the first longitudinal slot 127*a* and the second longitudinal slot 127*b*, respectively, of the body portion 118.

As shown in FIGS. 4B and 4C, in some implementations, a foil clamp 128 may be used to position and/or secure the first foil conductor 124*a* and the second foil conductor 124*b* against opposite sides of the insulating divider 132. In some implementations, the foil clamp 128 may be configured to not rotate when positioned within an opening 136 in the back side of the body portion 118. In some implementations, the foil clamp 128 may include a first flexible jaw member 129*a* and a second flexible jaw member 129*b* extending from a front side thereof (see, e.g., FIG. 4C). In some implementations, each jaw member 129*a*, 129*b* may be configured (e.g., tapered) to fit within the opening 136 in the back side of the body portion 118 of the plug 110 and interface with a first tapered surface 137*a* and a second tapered surface 137*b*, respectively, therein (see, e.g., FIG. 4C). In some implementations, the foil clamp 128 may include a slot 131 therethrough. In some implementations, the slot 131 passes between the jaw members 129*a*, 129*b* of the foil clamp 128. In some implementations, the slot 131 may be configured for the insulating divider 132 and adjacent segments of the foil conductors 124 to pass therethrough (see, e.g., FIG. 4C).

As shown in FIG. 4C, in some implementations, the foil clamp 128 may be removably secured to the body portion 118 of the plug 110 by the clamp nut 130. In some implementations, the clamp nut 130 may be configured to threadedly secure to the screw thread 119 of the body portion 118. In some implementations, the clamp nut 130 includes a shoulder 133 having an opening 135 therethrough. In some implementations, the shoulder 133 of the clamp nut 130 may be configured to engage with and hold the foil clamp 128 in the opening 136 of the body portion 118 when the clamp nut 130 is threadedly secured thereto (see, e.g., FIG. 4C). In this way, the clamp nut 130 may be used to removably secure the foil clamp 128 to the body portion 118 of the plug 110.

In some implementations, as the clamp nut 130 is being threadedly secured to the body portion 118 of the plug 110, the tapered surfaces 137*a*, 137*b* within the opening 136 of the body portion 118 may compress the jaw members 129*a*, 129*b* of the foil clamp 128 towards each other and thereby press the foil conductors 124 against the insulating divider 132. In this way, the foil clamp 128 may provide strain relief for, and/or ensure the proper positioning of, the foil conductors 124 within the body portion 118 of the plug 110.

As shown in FIGS. 4A and 4C, in some implementations, a gap 134 may be formed between the first protrusion 126, the second protrusion 126, and the front edge of the insulating divider 132. In some implementations, the gap 134 may be configured to receive the front portion (or first end) 172*a* of the insulating divider 172 extending from a jack 140 (see, e.g., FIG. 2C). In this way, the plug 110 and the jack 140 may be configured to maintain their orientation relative to each other and thereby preserve conductive contact between the male contacts 114*a*, 114*b* and the female contacts 144*a*, 144*b*.

In some implementations, the following steps may be used to removably secure the plug 110 to the jack 140 (see, e.g., FIGS. 2B and 2C).

Initially, in some implementations, the insulating washer 122 may be positioned about the body portion 118 of the plug 110 so that it is abutting the back side of the annular flange 120 thereof (see, e.g., FIG. 2B).

Then, in some implementations, the body portion 118 of the plug 110 may be inserted through the opening in the connector nut 112 and positioned so that the insulating washer 122 is resting against the shoulder 112*a* thereof (see, e.g., FIG. 4C).

Next, in some implementations, the connector nut 112 may be threadedly secured to the first screw thread 158 of the jack 140 (see, e.g., FIG. 2C). In this way, the plug 110 and the jack 140 may be removably secured together. In some implementations, the opening through the connector nut 112 may be configured to allow the connector nut 112 to fit over the clamp nut 130 during assembly.

In some implementations, the cylindrical body 142, insulating washer 150, foil clamp 146, clamp nut 148, and/or the retention nut 152 of the jack 140 may be manufactured from an electrical insulating material (e.g., nylon and/or Polyvinyl chloride (PVC)).

In some implementations, the body portion 118, insulating washer 122, foil clamp 128, clamp nut 130, and/or connector nut 112 of the plug 110 may be manufactured from an electrical insulating material (e.g., nylon and/or Polyvinyl chloride (PVC)).

In some implementations, the foil conductors 124, 144 used as part of the two-piece electrical connector 100 may be manufactured from copper, silver, gold, or other metal alloy suitable for transmitting an electrical signal. In some implementations, the foil conductors 124, 144 may have a rectangular cross-section. In some implementations, each foil conductor 124*a*, 124*b*, 144*a*, 144*b* is a single unitary piece of material (i.e., there are no breaks or soldered joints) thereby reducing signal degradation (e.g., skin effect, noise, distortion, etc.) during transmission. In some implementations, each foil conductor 124*a*, 124*b*, 144*a*, 144*b* may be between 0.002"-0.005" thick, inclusive of 0.002" and 0.005". In some implementations, each foil conductor 124*a*, 124*b*, 144*a*, 144*b* may be less than 0.002" thick or more than 0.005" thick. In some implementations, each foil conductor 124*a*, 124*b*, 144*a*, 144*b* may be 0.25" wide. In some implementations, each foil conductor 124*a*, 124*b*, 144*a*, 144*b* may be more than 0.25" wide or less than 0.25" wide.

In some implementations, a single cable may include a first plug 110 and a second plug 110 on a first end and a second end, respectively, thereof. In some implementations, the first foil conductor 124*a* of the first plug and the first foil conductor 124*a* of the second plug may be a single unitary piece of material (i.e., there are no breaks or soldered joints) that extends therebetween. In some implementations, the second foil conductor 124*b* of the first plug and the second foil conductor 124*b* of the second plug may be a single unitary piece of material (i.e., there are no breaks or soldered joints) that extends therebetween.

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown or in sequential order, or that all illustrated operations be performed, to achieve desirable results.

The invention claimed is:

1. A two-piece electrical connector comprising:

a plug, the plug comprises a first male contact and a second male contact that protrude from the plug at an angle, the first male contact is a segment of a first foil conductor and the second male contact is a segment of a second foil conductor, the first foil conductor and the second foil conductor are each a single unitary piece of material that extends from the plug; and a jack, the jack comprises a first female contact and a second female contact that are positioned within a receptacle thereof at an angle, the receptacle of the jack is configured to receive therein the first male contact and the second male contact of the plug, the first female contact is a segment of a third foil conductor and the second female contact is a segment of a fourth foil conductor, the third foil conductor and the fourth foil conductor are each a single unitary piece of material that extends from the jack;

wherein the plug and the jack are configured to connect together;

wherein the first male contact and the second male contact of the plug are configured to conductively interface with the first female contact and the second female contact of the jack, respectively;

wherein the receptacle of the jack includes an offset slot configured to receive an orientation member extending from between the first male contact and the second male contact of the plug, the offset slot of the jack and the orientation member of the plug are configured so that the plug and the jack can only be connected together in a single orientation; and wherein each foil conductor has a rectangular cross-section.

2. The two-piece electrical connector of claim 1, wherein the angle of the first female contact and the second female contact of the jack compliment the angle of the first male contact and the second male contact of the plug, respectively, thereby placing them into conductive contact.

3. The two-piece electrical connector of claim 1, wherein the plug further comprises a longitudinally extending insulating divider, the insulating divider of the plug is positioned between the first foil conductor and the second foil conductor; and wherein the jack further comprises a longitudinally extending insulating divider, the insulating divider of the jack is positioned between the third foil conductor and the fourth foil conductor.

4. The two-piece electrical connector of claim 3, wherein the plug further comprises a foil clamp, the foil clamp of the plug is configured to press the first foil conductor and the second foil conductor against opposite sides of the insulating divider; and wherein the jack further comprises a foil clamp, the foil clamp of the jack is configured to press the third foil conductor and the fourth foil conductor against opposite sides of the insulating divider.

5. The two-piece electrical connector of claim 3, wherein the insulating divider of the jack comprises a first end that extends into the receptacle thereof, the first end of the insulating divider is configured to be received between a portion of the first foil conductor and the second foil conductor of the plug.

6. The two-piece electrical connector of claim 5, wherein the plug further comprises a foil clamp, the foil clamp of the plug is configured to press the first foil conductor and the second foil conductor against opposite sides of the insulating divider; and wherein the jack further comprises a foil clamp, the foil clamp of the jack is configured to press the third foil conductor and the fourth foil conductor against opposite sides of the insulating divider.

7. A two-piece electrical connector comprising:

a plug, the plug comprises a first male contact and a second male contact that protrude from the plug at an angle, the first male contact is a segment of a first foil conductor and the second male contact is a segment of a second foil conductor, the first foil conductor and the second foil conductor are each a single unitary piece of material that extends from the plug, the plug also comprises a longitudinally extending insulating divider that is positioned between the first foil conductor and the second foil conductor; and a jack, the jack comprises a first female contact and a second female contact that are positioned within a receptacle thereof at an angle, the receptacle of the jack is configured to receive therein the first male contact and the second male contact of the plug, the first female contact is a segment of a third foil conductor and the second female contact is a segment of a fourth foil conductor, the third foil conductor and the fourth foil conductor are each a single unitary piece of material that extends from the jack, the jack also comprises a longitudinally extending insulating divider that is positioned between the third foil conductor and the fourth foil conductor;

wherein the plug and the jack are configured to connect together;

wherein the first male contact and the second male contact of the plug are configured to conductively interface with the first female contact and the second female contact of the jack, respectively; and wherein each foil conductor has a rectangular cross-section.

8. The two-piece electrical connector of claim 7, wherein the angle of the first female contact and the second female contact of the jack compliment the angle of the first male contact and the second male contact of the plug, respectively, thereby placing them into conductive contact.

9. The two-piece electrical connector of claim 7, wherein the receptacle of the jack includes an offset slot configured to receive an orientation member extending from between the first male contact and the second male contact of the plug, the offset slot of the jack and the orientation member of the plug are configured so that the plug and the jack can only be connected together in a single orientation.

10. The two-piece electrical connector of claim 7, wherein the plug further comprises a foil clamp, the foil clamp of the plug is configured to press the first foil conductor and the second foil conductor against opposite sides of the insulating divider; and wherein the jack further comprises a foil clamp, the foil clamp of the jack is configured to press the third foil conductor and the fourth foil conductor against opposite sides of the insulating divider.

11. The two-piece electrical connector of claim 7, wherein the insulating divider of the jack comprises a first end that extends into the receptacle thereof, the first end of the insulating divider is configured to be received between a portion of the first foil conductor and the second foil conductor of the plug.

12. The two-piece electrical connector of claim 11, wherein the receptacle of the jack includes an offset slot configured to receive an orientation member extending from between the first male contact and the second male contact of the plug, the offset slot of the jack and the orientation member of the plug are configured so that the plug and the jack can only be connected together in a single orientation.

13. The two-piece electrical connector of claim 11, wherein the plug further comprises a foil clamp, the foil clamp of the plug is configured to press the first foil conductor and the second foil conductor against opposite sides of the insulating divider; and wherein the jack further comprises a foil clamp, the foil clamp of the jack is configured to press the third foil conductor and the fourth foil conductor against opposite sides of the insulating divider.

* * * * *